US011611178B2

(12) United States Patent
Kim et al.

(10) Patent No.: US 11,611,178 B2
(45) Date of Patent: Mar. 21, 2023

(54) ELECTRICAL CONNECTOR CAPABLE OF EMI SHIELDING

(71) Applicant: SENSORVIEW CO., LTD., Gyeonggi-do (KR)

(72) Inventors: Byoung Nam Kim, Gyeonggi-do (KR); Kyoung Il Kang, Gyeonggi-do (KR); Dong Il Yim, Gyeonggi-do (KR)

(73) Assignee: SENSOR VIEW CO., LTD., Gyeonggi-do (KR)

( * ) Notice: Subject to any disclaimer, the term of this patent is extended or adjusted under 35 U.S.C. 154(b) by 14 days.

(21) Appl. No.: 17/411,142

(22) Filed: Aug. 25, 2021

(65) Prior Publication Data

US 2022/0247130 A1 Aug. 4, 2022

(30) Foreign Application Priority Data

Feb. 1, 2021 (KR) ..... 10-2021-0014150

(51) Int. Cl.

| | |
|---|---|
| ***H01R 13/6581*** | (2011.01) |
| ***H01R 13/6583*** | (2011.01) |
| ***H01R 13/11*** | (2006.01) |
| ***H01R 13/05*** | (2006.01) |
| ***H01R 13/516*** | (2006.01) |

(52) U.S. Cl.

CPC ..... *H01R 13/6583* (2013.01); *H01R 13/05* (2013.01); *H01R 13/11* (2013.01); *H01R 13/516* (2013.01)

(58) Field of Classification Search

CPC ..... H01R 13/6583; H01R 13/6581; H01R 13/648; H01R 13/05; H01R 13/11; H01R 13/516

USPC ..... 439/607.01

See application file for complete search history.

(56) References Cited

U.S. PATENT DOCUMENTS

| | | | | | |
|---|---|---|---|---|---|
| 4,506,937 | A * | 3/1985 | Cosmos | H01R 13/648 | 439/101 |
| 4,662,700 | A * | 5/1987 | Markham | H01R 12/775 | 439/607.52 |
| 4,842,543 | A * | 6/1989 | Davis | H01R 13/645 | 439/246 |
| 4,854,890 | A * | 8/1989 | Nishimura | H01R 13/6582 | 439/736 |
| 5,044,975 | A * | 9/1991 | DiBene, II | H01R 13/6275 | 439/153 |

(Continued)

*Primary Examiner* — Harshad C Patel

(74) *Attorney, Agent, or Firm* — Harness, Dickey & Pierce, P.L.C.

(57) ABSTRACT

An electrical connector is provided. The electrical connector capable of electromagnetic interference (EMI) shielding may include a female connector including a female portion in which a plurality of terminals are disposed; a male connector including a male portion including a plurality of pins electrically connected with the terminals; and a shielding member disposed between the female connector and the male connector, wherein the male portion includes an inner surface forming a space in which the pins are positioned and an end surface connected to the inner surface, the shielding member is formed of a conductive elastic body, a portion of the shielding member is disposed between the inner surface of the male portion and an outer surface of the female portion so as to be in contact with the inner surface of the male portion and the outer surface of the female portion.

4 Claims, 9 Drawing Sheets

(56) References Cited

U.S. PATENT DOCUMENTS 5,186,635 A * 2/1993 Pechulis ..... H01R 13/5219 439/271
5,356,300 A * 10/1994 Costello ..... H01R 12/7005 439/378
5,466,171 A * 11/1995 Bixler ..... H01R 13/6315 439/378
5,511,990 A * 4/1996 Klemen ..... H01R 13/748 439/559
6,139,351 A * 10/2000 Schaefer ..... B60L 3/0069 439/372
6,365,390 B1 * 4/2002 Blum ..... C12N 9/18 435/197
6,576,833 B2 * 6/2003 Covaro ..... H04B 10/508 174/359
8,029,324 B1 * 10/2011 Yi ..... H01R 13/518 439/745
8,425,250 B2 * 4/2013 Kagotani ..... H01R 12/7005 439/680
8,851,934 B2 * 10/2014 McAlonis ..... H01R 4/64 439/680
8,956,172 B2 * 2/2015 Matsumoto ..... H01R 13/6581 439/271
9,509,084 B2 * 11/2016 Zhao ..... H01R 43/005
9,722,349 B2 * 8/2017 Ishihara ..... H01R 13/5202
10,212,864 B1 * 2/2019 Roath ..... F16J 15/128
10,276,950 B1 * 4/2019 Amini ..... H01R 13/658
11,411,349 B1 * 8/2022 Wronowski ..... H01R 13/6584
2006/0141826 A1 * 6/2006 Olson ..... H01R 13/422 439/79
2010/0075535 A1 * 3/2010 Mizutani ..... H01R 43/24 439/588
2013/0122743 A1 * 5/2013 Soubh ..... H01R 13/6477 439/660
2014/0106588 A1 * 4/2014 Suzuki ..... H01R 13/5202 439/271
2018/0040988 A1 * 2/2018 Wang ..... H01R 13/6581

* cited by examiner

ELECTRICAL CONNECTOR CAPABLE OF EMI SHIELDING

CROSS-REFERENCE TO RELATED APPLICATION

This application claims the benefit under 35 USC § 119(a) of Korean Patent Application No. 10-2021-0014150, filed on Feb. 1, 2021, in the Korean Intellectual Property Office, the entire disclosure of which is incorporated herein by reference for all purposes.

FIELD

The following description relates to an electrical connector capable of electromagnetic interference (EMI) shielding, and to an electrical connector in which a shielding member for EMI shielding is disposed between a female connector and a male connector.

BACKGROUND

An electrical connector is a device used for data communication with or power supply to an external device. A male connector may include a plurality of pins, and a female connector may have a socket-type terminal into which the pins are inserted.

As the amount and rate of data transmitted through electrical connectors increases significantly, the importance of electromagnetic interference (EMI) shielding grows. For EMI shielding, a shielding member may be installed between a female connector and a male connector. The shielding member is annularly formed so as to be disposed along the periphery of the female connector or the male connector.

Such a shielding member may be disposed in an area where the female connector and the male connector overlap for coupling, and in the overlapping area, the shielding member is disposed at a gap provided between the female connector and the male connector for coupling. However, since the shielding member shields EMI only at one point where the shielding member is located, in the direction in which the female connector and the male connector face, there is a risk of EMI leakage depending on the movement of an external device to which the electrical connector is connected or the connection state of the electrical connector.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

An object of the present invention is to provide an electrical connector having a shielding member disposed on a female connector and a male connector and capable of effectively shielding electromagnetic interference (EMI).

The objects to be achieved by the present invention are not limited to the foregoing object, and additional objects, which are not mentioned herein, will be readily understood by those skilled in the art from the following description.

In one general aspect, there is provided an electrical connector capable of EMI shielding, the electrical connector including: a female connector including a female portion in which a plurality of terminals are disposed; a male connector including a male portion including a plurality of pins electrically connected with the terminals; and a shielding member disposed between the female connector and the male connector, wherein the male portion includes an inner surface forming a space in which the pins are positioned and an end surface connected to the inner surface, the shielding member is formed of a conductive elastic body, a portion of the shielding member is disposed between the inner surface of the male portion and an outer surface of the female portion so as to be in contact with the inner surface of the male portion and the outer surface of the female portion, and another portion of the shielding member is in contact with the end surface of the male portion.

Preferably, the inner surface of the male portion and the outer surface of the female portion may be spaced apart from each other.

Preferably, the shielding member may include a first surface in contact with the inner surface of the male portion and a second surface in contact with the end surface of the male portion, wherein the first surface and the second surface face different directions.

Preferably, the shielding member may include a first inclined surface that connects the first surface and the second surface, and the first inclined surface may be disposed to be spaced apart from the male portion.

Preferably, the first surface and the second surface may be disposed to protrude toward the inner surface of the male portion rather than toward the outer surface of the female portion.

Preferably, the shielding member may include a first chamfered surface that connects an end surface of the shielding member and the first surface.

Preferably, the female portion may include a groove concavely formed along a periphery of the outer surface thereof, and the shielding member may be disposed in the groove.

Preferably, the female connector may include a first housing including a third surface, the female portion may be disposed to protrude from the third surface, and the shielding member may include a fourth surface in contact with the third surface and a fifth surface in contact with the outer surface of the female portion.

Preferably, the male connector may include a second housing including a sixth surface, and the male portion may be disposed to protrude from the sixth surface.

Preferably, the female connector may include a bolt, the male connector may include a nut engaged with the bolt, the nut may include a first hole and a second hole communicating with the first hole, an inner diameter of the second hole may be greater than an inner diameter of the first hole, the nut may further include a first chamfered portion disposed on a boundary between the first hole and the second hole, and the bolt may include a first part having threads formed thereon and rotatably engaged with the first hole, a second part having an outer diameter smaller than an outer diameter of the first part, and a second chamfered portion disposed on a boundary between the first part and the second part.

Preferably, the end surface of the bolt may be disposed to protrude toward the male portion rather than toward the female portion.

Other features and aspects will be apparent from the following detailed description, the drawings, and the claims.

Figure 1:
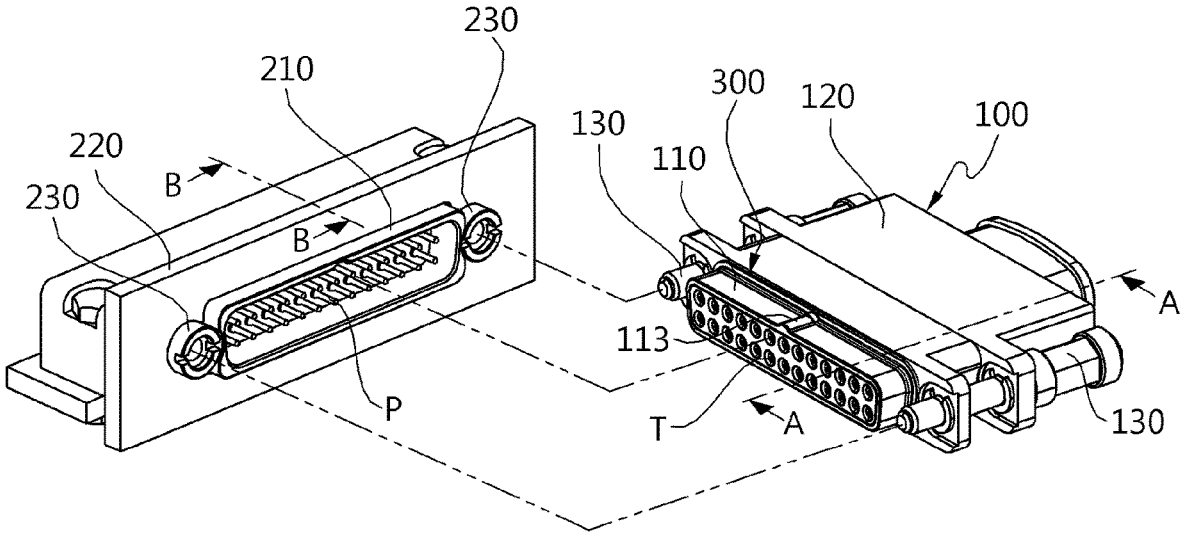
FIG. 1 is a perspective view of an electrical connector according to an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The objects, features and advantages of the present invention will be more clearly understood from the following detailed description and preferred embodiments taken in conjunction with the accompanying drawings. It should be understood that terms or words used in the specification and the appended claims should not be construed as being limited to commonly employed meanings or dictionary definitions, but interpreted based on meanings and concepts corresponding to the technical idea of the invention, on the basis of the principle that inventors are allowed to define terms appropriately for the best explanation of their invention. Further, in the description of the present invention, detailed descriptions of related well-known functions that are determined to unnecessarily obscure the gist of the present invention will be omitted.

In describing the elements of this specification, terms, such as the first, second, A, B, a, and b, may be used. However, the terms are used to only distinguish one element from other elements, but the essence, order, and sequence of the elements are not limited by the terms.

FIG. 1 is a perspective view of an electrical connector according to an embodiment.

Hereinafter, in describing embodiments, a "front-to-rear" direction refers to a coupling direction of a female connector and a male connector, which are arranged in parallel side by side to face each other, as shown in the drawings. In addition, terms "end" and "end surface" used herein are based on the front-to-rear direction.

Referring to FIG. 1, an electrical connector may include a female connector 100, a male connector 200 coupled to the female connector 100, and a shielding member 300. The female connector 100 and the male connector 200 are detachably coupled to each other along the front-to rear direction.

The female connector 100 may include a female portion 110 including a plurality of terminals T, a first housing 120, and bolts 130. The female portion 110 may be disposed to protrude from the first housing 120 in the front-to-rear direction. The terminals T may be electrically connected to a printed circuit board (PCB), a flexible printed circuit board (FPCB), or the like. The bolts 130 may be each disposed on both lateral sides of the first housing 120. The bolts 130 are provided for engaging with the male connector 200.

The male connector 200 may include a male portion 210 including a plurality of pins P, a second housing 220, and nuts 230. The male portion 210 may be disposed to protrude from the second housing 220 in the front-to-rear direction. The male portion 210 may have a space formed therein into which the female portion 110 is inserted, and the plurality of pins P may be disposed in the space.

The shielding member 300 may be disposed on the outer surface of the female portion 110 of the female connector 100. The shielding member 300 may be made of an elastically deformable conductive material.

Figure 2:
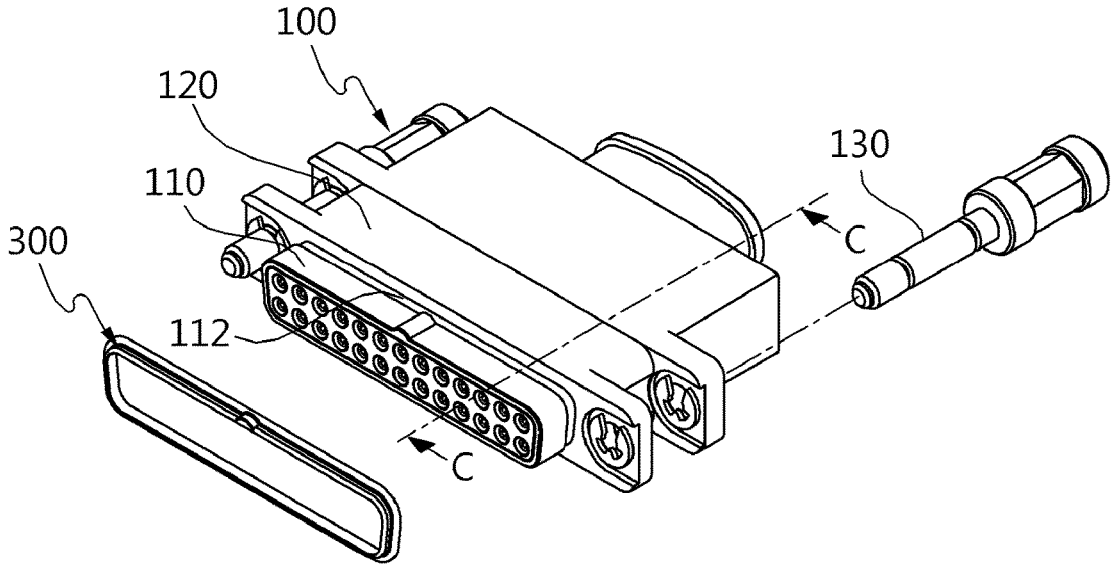
FIG. 2 is an exploded view of a female connector shown in FIG. 1.
Figure 3:
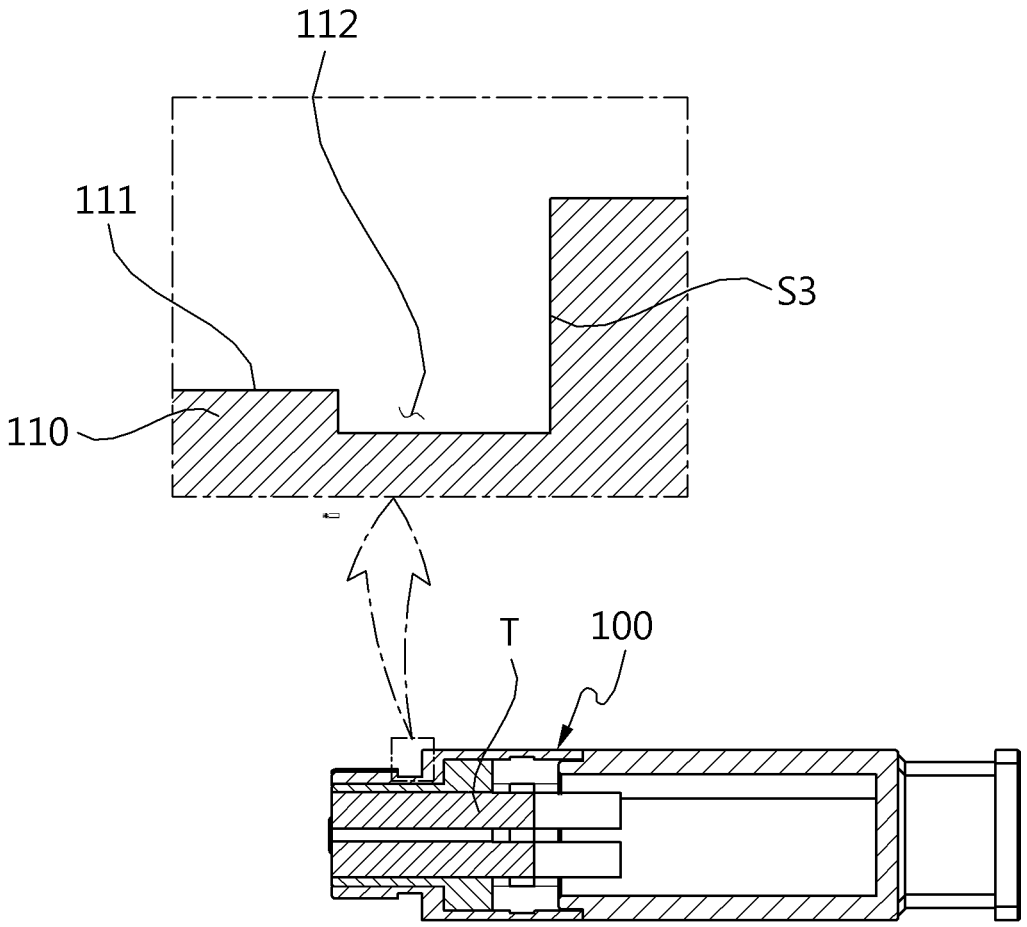
FIG. 3 is a side cross-sectional view of the female connector, taken along line C-C in FIG. 2.

FIG. 2 is an exploded view of the female connector 100 shown in FIG. 1, and FIG. 3 is a side cross-sectional view of the female connector 100, taken along line C-C in FIG. 2.

Referring to FIG. 2, the female portion 110 of the female connector 100 may protrude from a third surface S3 of the first housing 120 in the front-to-rear direction. The third surface S3 may be disposed such that an extended portion of the third surface S3 is perpendicular to the front-to-rear direction. Terminals T into which the pins P of the male portion 210 are inserted (electrically connected) are disposed inside the female portion 110.

The female portion 110 may be disposed in a groove 112 in which the shielding member 300 is mounted. The groove 112 is concavely formed on an outer surface 111 of the female portion 110, and may be disposed along the periphery of the female portion 110 so that a part of the third surface S3 becomes the side wall of the groove 112. Here, the outer surface 111 of the female portion 110 is a region that overlaps an inner surface 211 of the male portion 210 when the female connector 100 and the male connector 200 are coupled together, and it is disposed facing the inner surface 211 of the male portion 210 at a certain distance.

The female portion 110 may include a protrusion 113 disposed at the center thereof.

Figure 4:
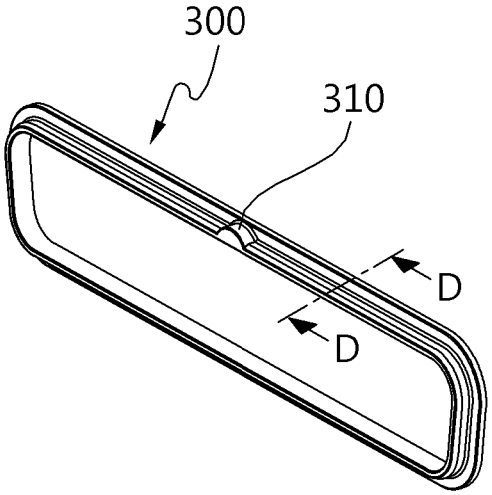
FIG. 4 is a view of a shielding member.
Figure 5:
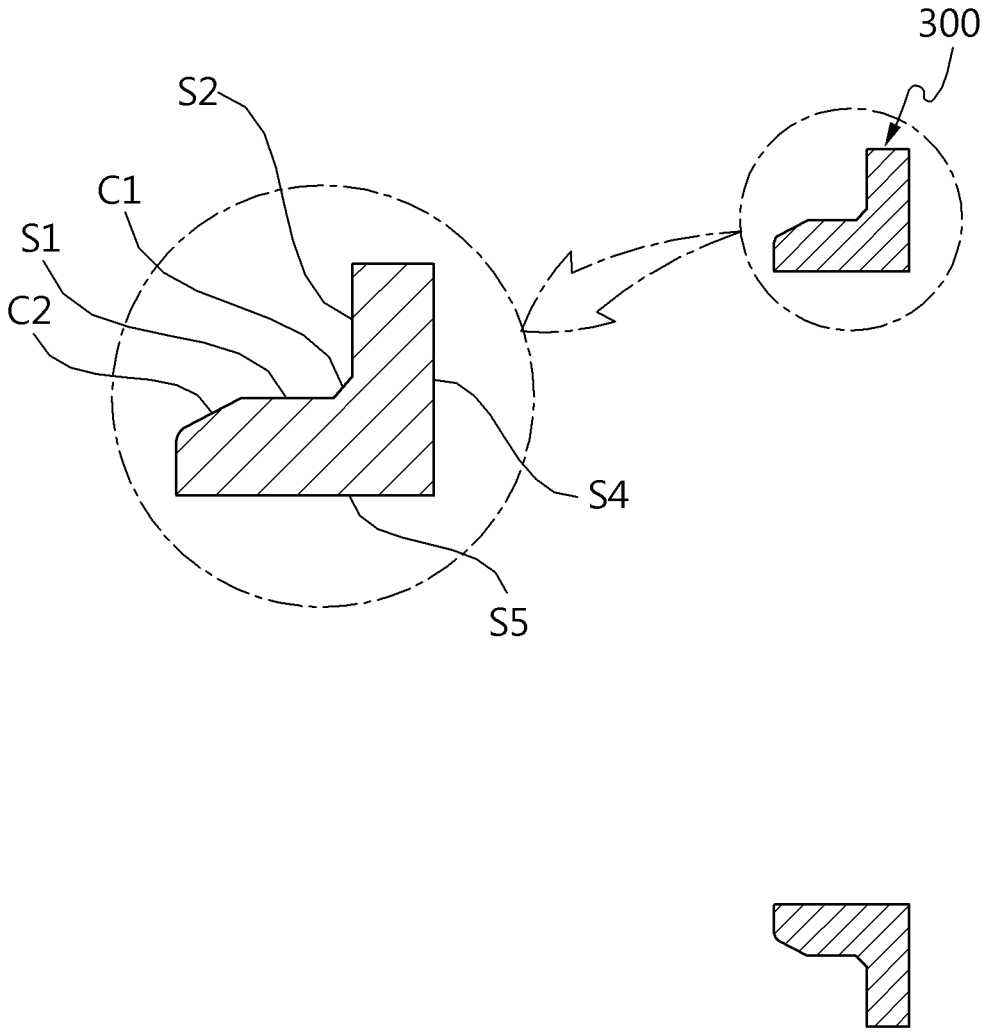
FIG. 5 is a side cross-sectional view of the shielding member, taken along line D-D in FIG. 4.

FIG. 4 is a view of the shielding member 300, and FIG. 5 is a side cross-sectional view of the shielding member 300, taken along line D-D in FIG. 4.

Referring to FIGS. 4 and 5, the shielding member 300 is an annular member mounted on the outer surface 111 of the female portion 110. The female portion 110 is placed inside the shielding member 300. The shape and size of the shielding member 300 may correspond to the shape and size of the female portion 110. The shielding member 300 is made of a conductive elastic material and hence, in the process of mating the female connector 100 to the male connector 200, it contracts and produces the restoring force, thereby increasing adhesion to the male portion 210.

The shielding member 300 is in contact with an end surface 212 of the male portion 210 as well as the outer surface 111 of the female portion 110 and the inner surface 211 of the male portion 210, thereby shielding EMI. The specific configuration of the shielding member 300 is as follows.

The shielding member 300 may include a first surface 51 and a second surface S2. The second surface S2 may be disposed perpendicularly to the first surface 51, so that the cross-sectional shape of the shielding member 300 has a generally "L" shape. The first surface 51 is surface that is in contact with an inner surface (211 in FIG. 7) when the female connector 100 and the male connector 200 are coupled to each other. In addition, the second surface S2 is a surface that is in contact with an end surface (212 in FIG. 7) of the male portion 210.

The first surface 51 and the second surface S2 may be connected to each other by a first inclined surface C1. The first inclined surface C1 may be disposed to be spaced apart from the female portion 110 when the female connector 100 and the male connector 200 are coupled to each other. Accordingly, the shielding member 300 easily enters the inside of the male portion 210 until the end surface 212 of the male portion 210 is in contact with the second surface S2 of the second surface S2.

Further, a second inclined surface C2 may be disposed at a boundary between the end surface of the shielding member 300 and the first surface 51. In the electrical connector according to the embodiment, due to the second inclined surface C2, the shielding member 300 may easily enter the inside of the male portion 210 without being caught on the end surface 212 of the male portion 210 when the female connector 100 and the male connector 200 are coupled to each other.

The shielding member 300 may include a fourth surface S4 and a fifth surface S5. The fourth surface S4 may be disposed perpendicularly to the fifth surface S5. The fourth surface S4 is a surface in contact with the third surface S3 of the first housing 120 of the female portion 110. The fifth surface S5 is a surface in contact with the outer surface 111 (e.g., a bottom surface of the groove 112) of the male portion 110.

The shielding member 300 may have a protruding portion 310 aligned with the protrusion (113 in FIG. 1) disposed on the female portion 110.

Figure 6:
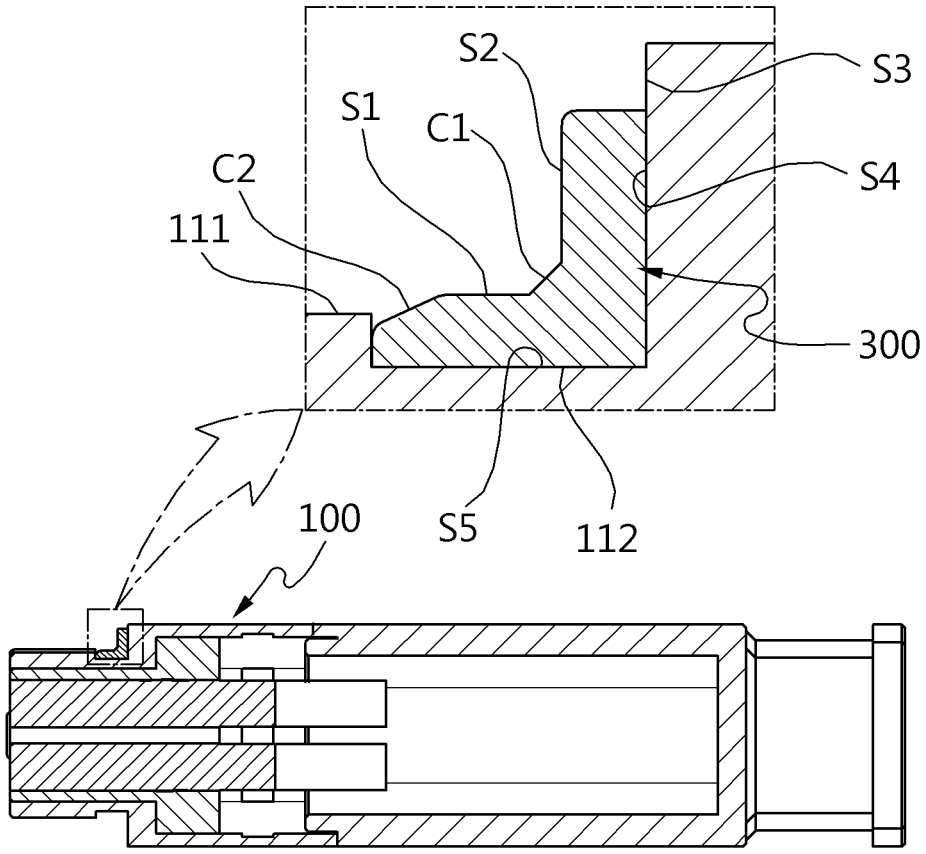
FIG. 6 is a side cross-sectional view of a female connector equipped with a shielding member, taken along line A-A in FIG. 1.

FIG. 6 is a side cross-sectional view of the female connector 100 equipped with the shielding member 300, taken along line A-A in FIG. 1.

Referring to FIG. 6, the shielding member 300 is seated in the groove 112 of the female portion 110. With the shielding member 300 seated in the groove 112, the fourth surface S4 is supported by the third surface S3 of the first housing 120 in the front-to-rear direction. The fifth surface S5 is in contact with the bottom surface of the groove 112. The first surface 51 is required to protrude beyond at least the outer surface 111 of the male portion 110. Since there is a play between the outer surface 111 of the female portion 110 and the inner surface 211 of the male portion 210, for easy coupling of the female portion 110 and the male portion 210, the first surface 51 may protrude beyond at least the outer surface 111 of the female portion 110 so as to contact the inner surface 211 of the male portion 210. The second inclined surface C2 also protrudes beyond the outer surface 111 of the female portion 110.

Figure 7:
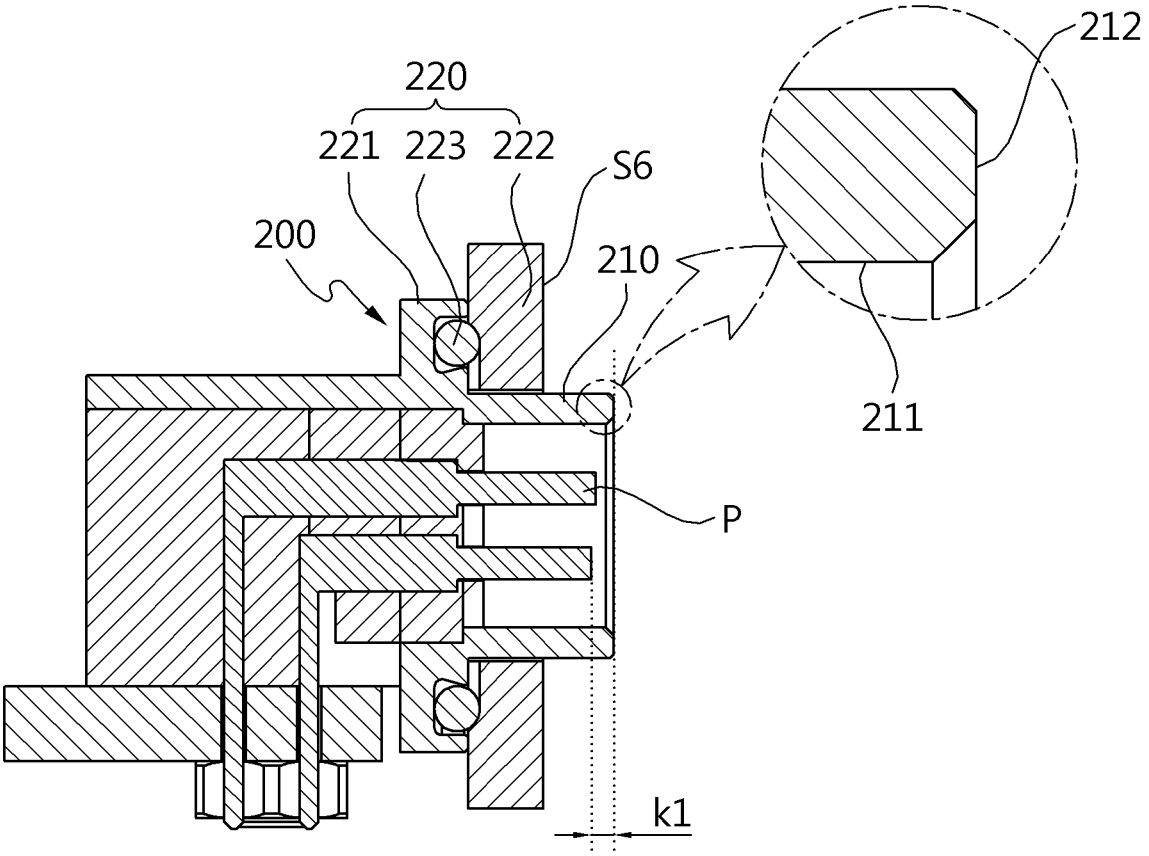
FIG. 7 is a side cross-sectional view of a male connector, taken along line B-B in FIG. 1.

FIG. 7 is a side cross-sectional view of the male connector 200, taken along line B-B in FIG. 1.

Referring to FIG. 7, the male portion 210 of the male connector 200 may protrude from a sixth surface S6 of the second housing 220 in the front-to-rear direction. The sixth surface S6 may be disposed such that an extended portion of the sixth surface S6 is perpendicular to the front-to-rear direction. The male portion 210 has a space formed therein into which the female portion 110 is inserted, and the plurality of pins P are disposed in the space.

The male portion 210 includes an inner surface 211 and an end surface 212 connected to the inner surface 211. The inner surface 211 may be elongated along the front-to-rear direction, and the end surface 212 may be disposed perpendicularly to the inner surface 211 to face the third surface S3 of the first housing 120 of the female connector 100.

The end of each pin P in the front-to-rear direction may be spaced apart from the end surface 212 of the male portion 210 by a predetermined distance and be positioned inside the male portion 210. Accordingly, it is possible to prevent the pin P from being damaged due to the end of the pin P being caught by an operator or an external device.

The second housing 220 may include a flange 221, a cover 222 for covering the flange 221, and an O-ring 223 disposed between the flange 221 and the cover 222. The cover 222 may be disposed outside of the male portion 210. The O-ring 223 may be made of a conductive elastic member, such as conductive silicone, capable of EMI shielding. The O-ring 223 further prevents the leakage of EMI.

Figure 8:
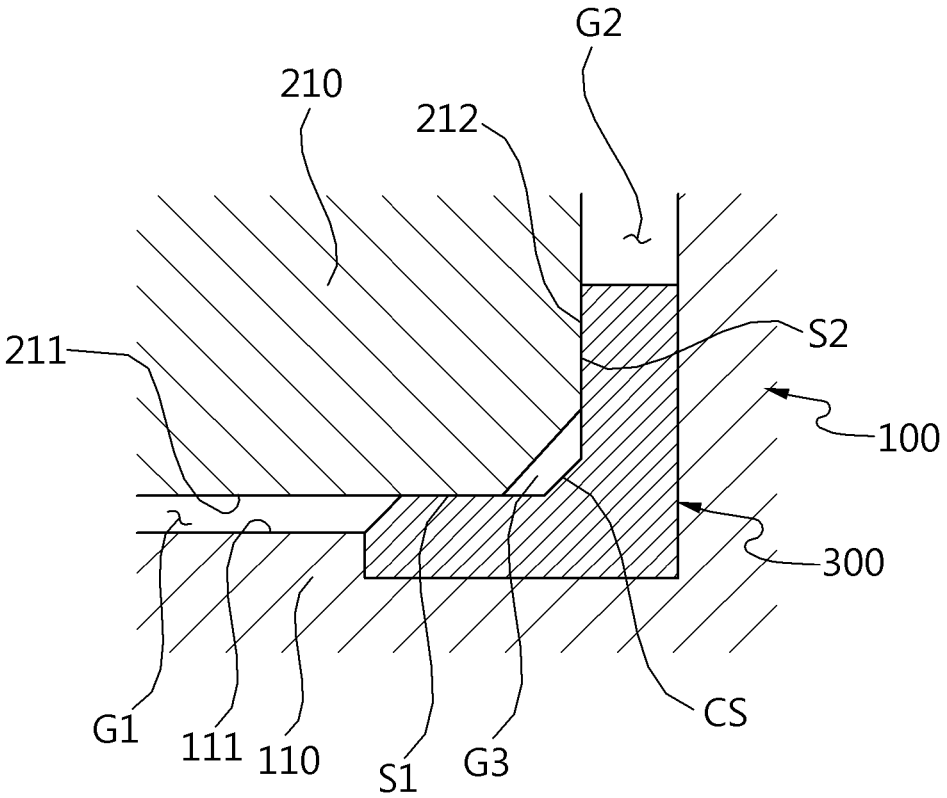
FIG. 8 is a view showing a state in which a shielding member is in contact with a male portion of a male connector coupled to a female connector.

FIG. 8 is a view showing a state in which the shielding member 300 and the male portion 210 of the male connector 200 are in contact with each other in a state in which the female connector 100 and the male connector 200 are coupled to each other.

Referring to FIG. 8, when the female connector 100 and the male connector 200 are coupled to each other, the shielding member 300 provides shielding at two points. First, a gap G1 between the inner surface 211 of the male portion 210 and the outer surface 111 of the female portion 110 disposed along the front-to-rear direction is blocked to prevent EMI from leaking. In addition, a gap G2 between the third surface S3 of the first housing 120 and the end surface 212 of the male portion 210 disposed along the direction perpendicular to the front-to-rear direction is blocked to prevent EMI from leaking.

As a portion of the shielding member 300 enters along the inner surface 211 of the male portion 210, the shielding member 300 is pressed, while generating the restoring force in a direction perpendicular to the front-to-rear direction. Therefore, the adhesion in the overlapping area of the female portion 110 and the male portion 210 is increased and thus the shielding performance is improved. Further, as the shielding member 300 continues to enter along the inner surface 211 of the male portion 210, the end surface 212 of the male portion 210 presses another region of the shielding member 300, so that the adhesion in the overlapping area of the male portion 210 and the first housing 120 is increased and thus the shielding performance is further improved.

In this way, the electrical connector according to the embodiment provides shielding at two points in different directions through the single shielding member 300, thereby providing high shielding performance.

Figure 9:
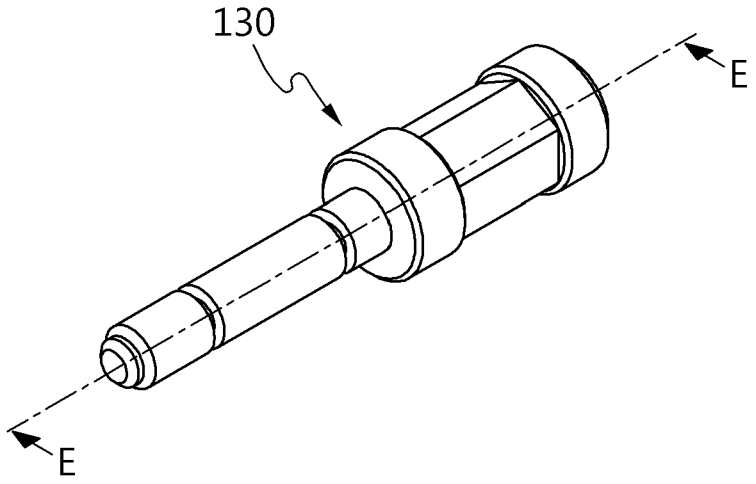
FIG. 9 is a view of a bolt.
Figure 10:
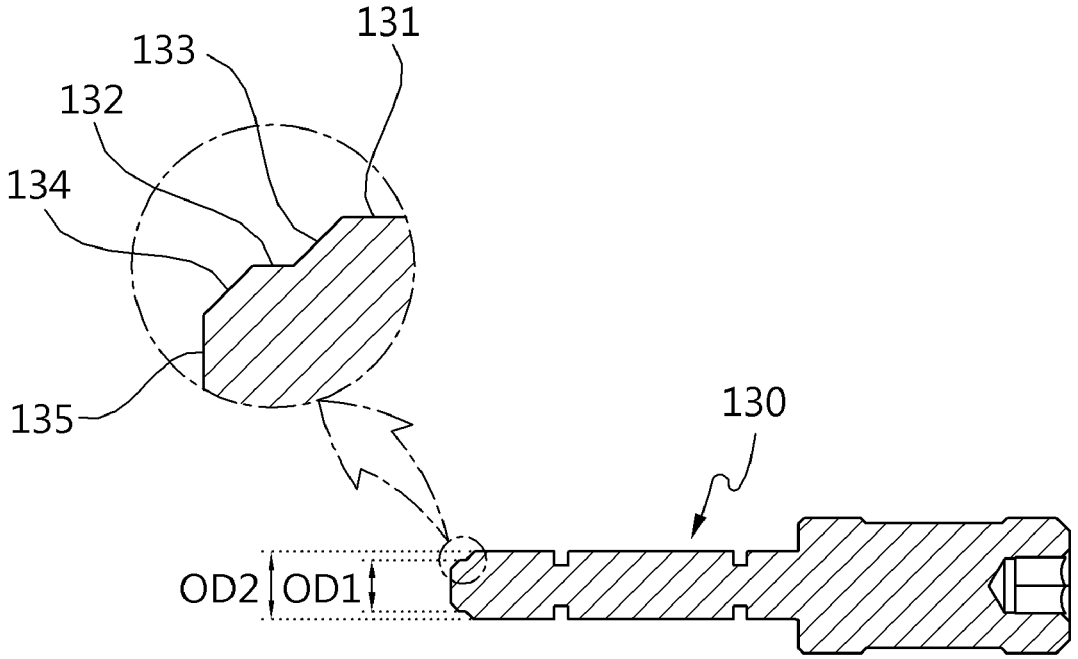
FIG. 10 is a side cross-sectional view of the bolt, taken along line E-E in FIG. 9.

FIG. 9 is a view of the bolt 130, and FIG. 10 is a side cross-sectional view of the bolt 130, taken along line E-E of FIG. 9.

Referring to FIGS. 9 and 10, the bolt 130 is a member used for mechanically fastening the female connector 100 and the male connector 200. The bolt 130 may be disposed on the female connector 100 and fastened to the nut 230 disposed on the male connector 200. Because the positions of the bolt 130 and the nut 230 determine the position of the terminal T of the female connector 100 and the position of the pin P of the male connector 200, respectively, they need to be precisely managed. In particular, the positions of the bolt 130 and the nut 230 immediately before the bolt 130 is fastened to the nut 230 are important because they determine the position of the pin P and the position of the terminal T.

In order to align the bolt 130 and the nut 230, the bolt 130 may be disposed such that its end is separated into a first part 131 and a second part 132, and the bolt 130 may include a second chamfered portion 133 that connects the first part 131 and the second part 132. The outer diameter OD2 of the second part 132 is smaller than the outer diameter OD1 of the first part 131. The first part 131 may have threads formed on the outer surface thereof. The second chamfered portion 133 is a region in which the outer diameter gradually decreases from the first part 131 to the second part 132. An end surface 135 of the bolt 130 and the second part 132 may be connected to each other by a third chamfered portion 124.

Figure 11:
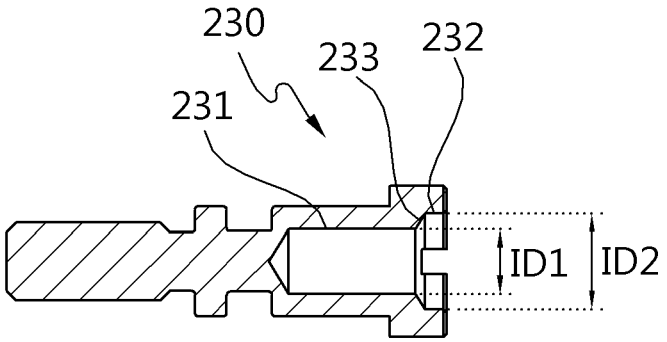
FIG. 11 is a side cross-sectional view of a nut.
Figure 12:
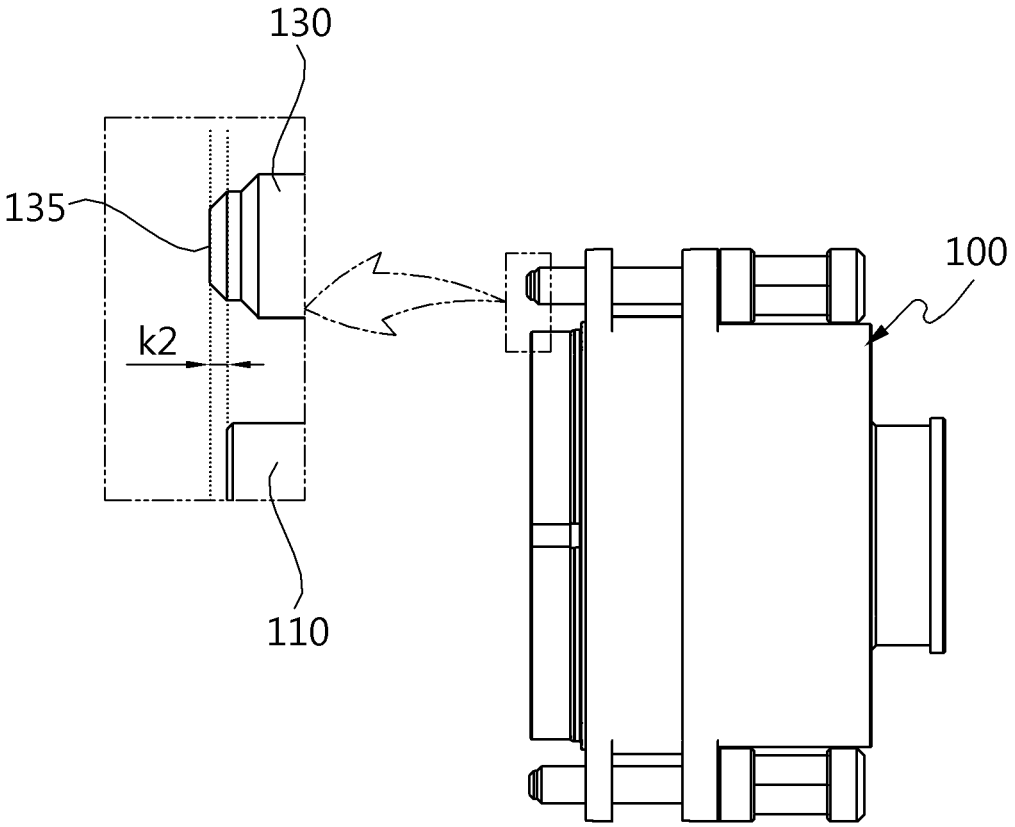
FIG. 12 is a plan view of a female connector showing a comparison of the position of an end surface of a bolt and the position of an end surface of a female portion.

FIG. 11 is a side cross-sectional view of the nut 230, and FIG. 12 is a plan view of the female connector 100 showing a comparison of the position of the end surface 135 of the bolt 130 and the position of the end surface of the female portion 110.

Referring to FIGS. 10 to 12, in order to align the bolt 130 and the nut 230, the nut 230 may include a first hole 231 and a second hole 232 communicating with the first hole 231, and a first chamfered portion 233 may be disposed on a boundary between the first hole 231 and the second hole 232. The inner diameter ID2 of the second hole 232 is greater than the inner diameter ID1 of the first hole 231. The second hole 232 is disposed outside the first hole 231 in the front-to-rear direction. In addition, the first hole 231 may have threads formed therein.

When the female portion 110 starts to enter the inside of the male portion 210, the bolt 130 starts to enter the nut 230. In addition, the second part 132 of the bolt 130 first enters the second hole 232 of the nut 230. Since there is a play between the outer surface 111 of the female portion 110 and the inner surface 211 of the male portion 210, even when the female portion 110 starts to enter the male portion 210, the pin P and the terminal T may not yet have been accurately aligned with each other. However, since the inner diameter ID2 of the second hole 232 is greater than the outer diameter OD2 of the second part 132 of the bolt 130, the second part 132 of the bolt 130 easily enters the inside of the nut 230.

When the bolt 130 continues to enter the nut 230, the second chamfered portion 133 of the bolt 130 comes into contact with the first chamfered portion 233 of the nut 230, and the bolt 130 is guided into the first hole 231. As the bolt 130 is guided into the first hole 231, the pin P and the terminal T are accurately aligned with each other. The first part 131 of the bolt 130 is rotatably engaged with the first hole, the female connector 100 and the male connector 200 are coupled to each other. In addition, in a state in which the pin P and the terminal T are aligned with each other, the pin P is inserted into and electrically connected to the terminal T.

As shown in FIG. 12, the end surface 135 of the bolt 130 is disposed to protrude by a predetermined distance from the protruding portion of the female portion 110 in the front-to-rear direction, so that the bolt 130 may be guided into the first hole 231 before the pin P comes into contact with the terminal T.

In this way, the pin P and the terminal T are naturally aligned in the process in which the bolt 130 is engaged with the nut 230, and thus it is possible to prevent the pin P from being damaged due to misalignment of the pin P and the terminal T.

According to the embodiment, it is possible to provide EMI shielding at two points in the direction in which the female connector and the male connector face each other, by using one shielding member.

According to the embodiment, it is possible to provide EMI shielding at two points in different directions by using one shielding member.

According to an embodiment, the shielding member is made of an elastically deformable material, so that in the process of coupling the female connector to the male connector, the shielding member is in close contact with the female connector and the male connector, thereby increasing the EMI shielding property.

According to the embodiment, since a part of the shielding member is in contact with the end surface of the male portion of the male connector as well as the inner surface of the male portion, it is possible to increase the EMI shielding property.

According to the embodiment, in the groove portion of the nut, the inner diameter of the second hole is greater than the inner diameter of the first hole, and the first chamfered portion is disposed on the boundary between the first hole and the second hole, so that the alignment of the pins of the male connector and the terminals of the female connector is easy.

According to the embodiment, in the process of mating the female connector to the male connector, the second chamfered portion of the bolt is guided by the first chamfered portion of the groove portion before the pins bring into contact with the terminals, and thus it is possible to prevent the pins from being damaged due to misalignment of the pins and the terminals.

The electrical connector capable of EMI shielding according to one exemplary embodiment of the present invention have been specifically described above with reference to the accompanying drawings.

The above described one embodiment of the present invention should be considered in a descriptive sense only and not for the purpose of limitation and the scope of the present invention shall be represented according to the claims below rather than the foregoing detailed description of the embodiment. And, it should be understood that all modifications or alternatives derived from the spirit, scope and equivalent concept of the claims fall within the scope of the present invention.

What is claimed is:

1. An electrical connector capable of electromagnetic interference (EMI) shielding, the electrical connector comprising:

a female connector including a female portion in which a plurality of terminals are disposed;

a male connector including a male portion including a plurality of pins electrically connected with the terminals; and a shielding member disposed between the female connector and the male connector, wherein the male portion includes an inner surface forming a space in which the pins are positioned and an end surface connected to the inner surface, the shielding member is formed of a conductive elastic body, a portion of the shielding member is disposed between the inner surface of the male portion and an outer surface of the female portion so as to be in contact with the inner surface of the male portion and the outer surface of the female portion, and another portion of the shielding member is in contact with the end surface of the male portion to provide EMI shielding, wherein the inner surface of the male portion and the outer surface of the female portion are spaced apart from each other, wherein the shielding member includes a first surface in contact with the inner surface of the male portion and a second surface in contact with the end surface of the male portion, wherein the first surface and the second surface face different directions, wherein the shielding member includes a first inclined surface that connects the first surface and the second surface and the first inclined surface is disposed to be spaced apart from the male portion, wherein the first surface and the second surface are disposed to protrude toward the inner surface of the male portion rather than toward the outer surface of the female portion.

2. An electrical connector capable of electromagnetic interference (EMI) shielding, the electrical connector comprising:

a female connector including a female portion in which a plurality of terminals are disposed;

a male connector including a male portion including a plurality of pins electrically connected with the terminals; and a shielding member disposed between the female connector and the male connector, wherein the male portion includes an inner surface forming a space in which the pins are positioned and an end surface connected to the inner surface, the shielding member is formed of a conductive elastic body, a portion of the shielding member is disposed between the inner surface of the male portion and an outer surface of the female portion so as to be in contact with the inner surface of the male portion and the outer surface of the female portion, and another portion of the shielding member is in contact with the end surface of the male portion to provide EMI shielding, wherein the female connector includes a first housing including a third surface, the female portion is disposed to protrude from the third surface, and the shielding member includes a fourth surface in contact with the third surface and a fifth surface in contact with the outer surface of the female portion.

3. The electrical connector of claim 2, wherein the male connector includes a second housing including a sixth surface and the male portion is disposed to protrude from the sixth surface.

4. An electrical connector capable of electromagnetic interference (EMI) shielding, the electrical connector comprising:

a female connector including a female portion in which a plurality of terminals are disposed;

a male connector including a male portion including a plurality of pins electrically connected with the terminals; and a shielding member disposed between the female connector and the male connector, wherein the male portion includes an inner surface forming a space in which the pins are positioned and an end surface connected to the inner surface, the shielding member is formed of a conductive elastic body, a portion of the shielding member is disposed between the inner surface of the male portion and an outer surface of the female portion so as to be in contact with the inner surface of the male portion and the outer surface of the female portion, and another portion of the shielding member is in contact with the end surface of the male portion to provide EMI shielding, wherein the female connector includes a bolt, the male connector includes a nut engaged with the bolt, the nut includes a first hole and a second hole communicating with the first hole, an inner diameter of the second hole is greater than an inner diameter of the first hole, the nut further includes a first chamfered portion disposed on a boundary between the first hole and the second hole, and the bolt includes a first part having threads formed thereon and rotatably engaged with the first hole, a second part having an outer diameter smaller than an outer diameter of the first part, and a second chamfered portion disposed on a boundary between the first part and the second part.

* * * * *